US006386940B1

(12) United States Patent
Chang

(10) Patent No.: US 6,386,940 B1
(45) Date of Patent: May 14, 2002

(54) MOTION TOY TRANSMISSION MECHANISM

(76) Inventor: Chao Chang Chang, No. 50, Lane 187, Nanya Street, Hsinchu City (TW)

( * ) Notice: Subject to any disclaimer, the term of this patent is extended or adjusted under 35 U.S.C. 154(b) by 0 days.

(21) Appl. No.: 09/577,431

(22) Filed: May 22, 2000

(51) Int. Cl.[7] ..... G09F 19/00

(52) U.S. Cl. ..... 446/236; 446/265; 84/95.2; 40/411

(58) Field of Search ..... 446/236, 237, 446/238, 246, 265, 330, 352, 358; 84/95.2; 40/411, 415

(56) References Cited

U.S. PATENT DOCUMENTS 5,313,727 A * 5/1994 Murray, Jr. ..... 446/236
5,986,189 A * 11/1999 Yang ..... 84/95.2
6,038,798 A * 3/2000 Liu ..... 40/411

* cited by examiner

*Primary Examiner*—Jacob K. Ackun
(74) *Attorney, Agent, or Firm*—Pro-Techtor International Services

(57) ABSTRACT

A motion toy transmission mechanism includes a bottom plate, a clockwork-driven musical box fixedly mounted on the bottom plate, the clockwork-driven musical box having a clockwork shaft and a handle fixedly fastened to the clockwork shaft and spaced below the bottom plate for turning by hand to fasten up the clockwork of the musical box, a drive gear fixedly mounted on the output shaft of the musical box, a driven gear mounted on the bottom plate and meshed with the drive gear; a rotary disk supported on the bottom plate and rotated by the driven gear upon releasing of the clockwork of the musical box, the rotary disk having an internal gear meshed with the driven gear, and a pressure member mounted on the bottom plate and spaced around the musical box to guide rotary motion of the rotary disk.

4 Claims, 7 Drawing Sheets

MOTION TOY TRANSMISSION MECHANISM

BACKGROUND OF THE INVENTION

The present invention relates a motion toy transmission mechanism, and more particularly to such a motion toy transmission mechanism, which uses a musical box to rotate a rotary disk and ornamental items on the rotary disk.

A variety of musical box incorporated motion toys have been disclosed, and have appeared on the market. These motion toys commonly use a clockwork-driven musical box to move ornamental items. Different transmission means may be used and coupled between the output shaft of the musical box and the ornamental items, enabling the ornamental items to make a linear or circular motion. FIGS. from 1 through 4 show a motion toy of this kind. This structure of motion toy 10 comprises a transmission mechanism 11. The transmission mechanism 11 comprises a bottom plate 13, an annular rotary disk 12 supported on the bottom plate 13 and holding a variety of ornamental items 24, the rotary disk 12 having a center opening 14 and an internal gear 15 around the center opening 14, three driven gears 16 mounted on the bottom plate 13 and spaced from one another at 120° and meshed with the internal gear 15, and a musical box holder 17 fixedly fastened to the bottom plate 13 by screws 18 to hold an ornament 19 and a musical box 20. The musical box 20 is fixedly fastened to a chamber 26 in the musical box holder 17 by screws 25, having a clockwork shaft 21 extended downwards. The clockwork shaft 21 is fixedly mounted with a drive gear 22. Further, three idle gears 23 are respectively meshed between the drive gear 22 and the driven gears 16. When the user rotates the rotary disk 12, the driven gears 16 are turned to rotate the drive gear 22 through the idle gears 23, thereby causing the clockwork shaft 21 to fasten up the clockwork of the musical box 20 and to preserve energy. When releasing the hand from the rotary disk 12, the clockwork gradually releases preserved energy to the clockwork shaft 21, thereby causing the clockwork shaft 21 to rotate. During rotary motion of the clockwork shaft 21, the drive gear 22 is moved to rotate the rotary disk 12 through the idle gears 23 and the driven gear 16. Because many gears 16, 22 and 23 are used to transmit rotary driving force from the clockwork shaft 21 to the rotary disk 12, much friction resistance is produced during the transmission of rotary driving force, thereby causing a significant loss of rotary driving force. Furthermore, it inconvenient to fasten up the clockwork of the musical box 20. When turning the clockwork shaft 21 to fasten up the clockwork of the musical box 20 much effort should be employed to the rotary disk 12. Because no handle means is provided for turning the clockwork shaft to fasten up the clockwork of the musical box, the consumer may not know the way to fasten up the clockwork of the musical box.

SUMMARY OF THE INVENTION

The present invention has been accomplished under the circumstances in view. It is the main object of the present invention to provide a motion toy transmission mechanism, which eliminates the aforesaid drawbacks. According to the present invention, the motion toy transmission mechanism comprises a bottom plate, a clockwork-driven musical box fixedly mounted on the bottom plate, the clockwork-driven musical box having a clockwork shaft downwardly extended through a hole on the bottom plate and a handle fixedly fastened to the clockwork shaft for turning by hand to fasten up the clockwork of the clockwork-driven musical box, a drive gear fixedly mounted on the output shaft of the musical box, a driven gear mounted on the bottom plate and meshed with the drive gear; a rotary disk supported on the bottom plate to hold ornamental means and rotated by the driven gear upon releasing of the clockwork of the musical box, the rotary disk having an internal gear meshed with the driven gear, and a pressure member mounted on the bottom plate and spaced around the musical box to guide rotary motion of the rotary disk.

DETAILED DESCRIPTION OF THE PREFERRED EMBODIMENT

Figure 1:
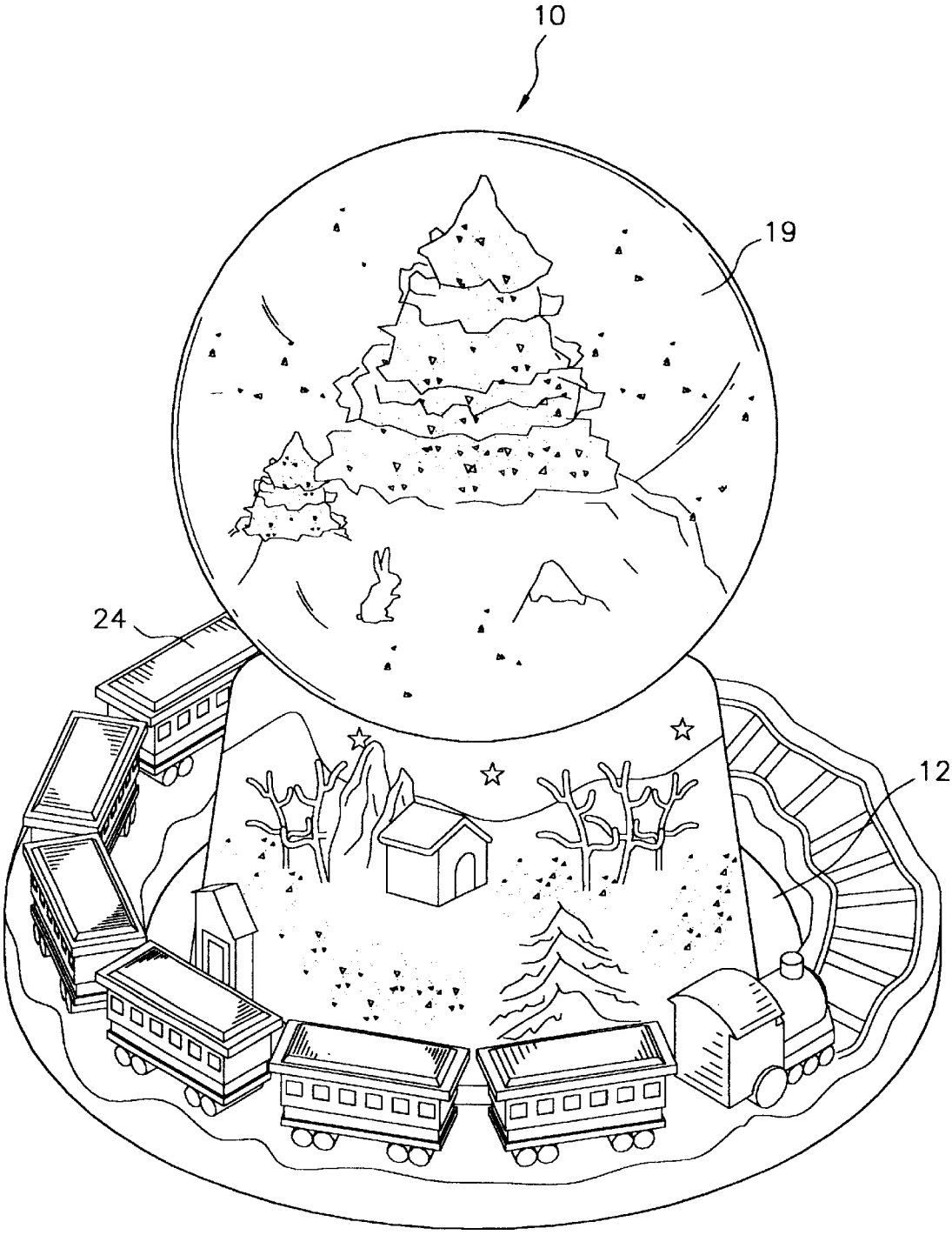
FIG. 1 (Prior Art)
FIG. 1 is a perspective view of a motion toy according to the prior art.
Figure 2:
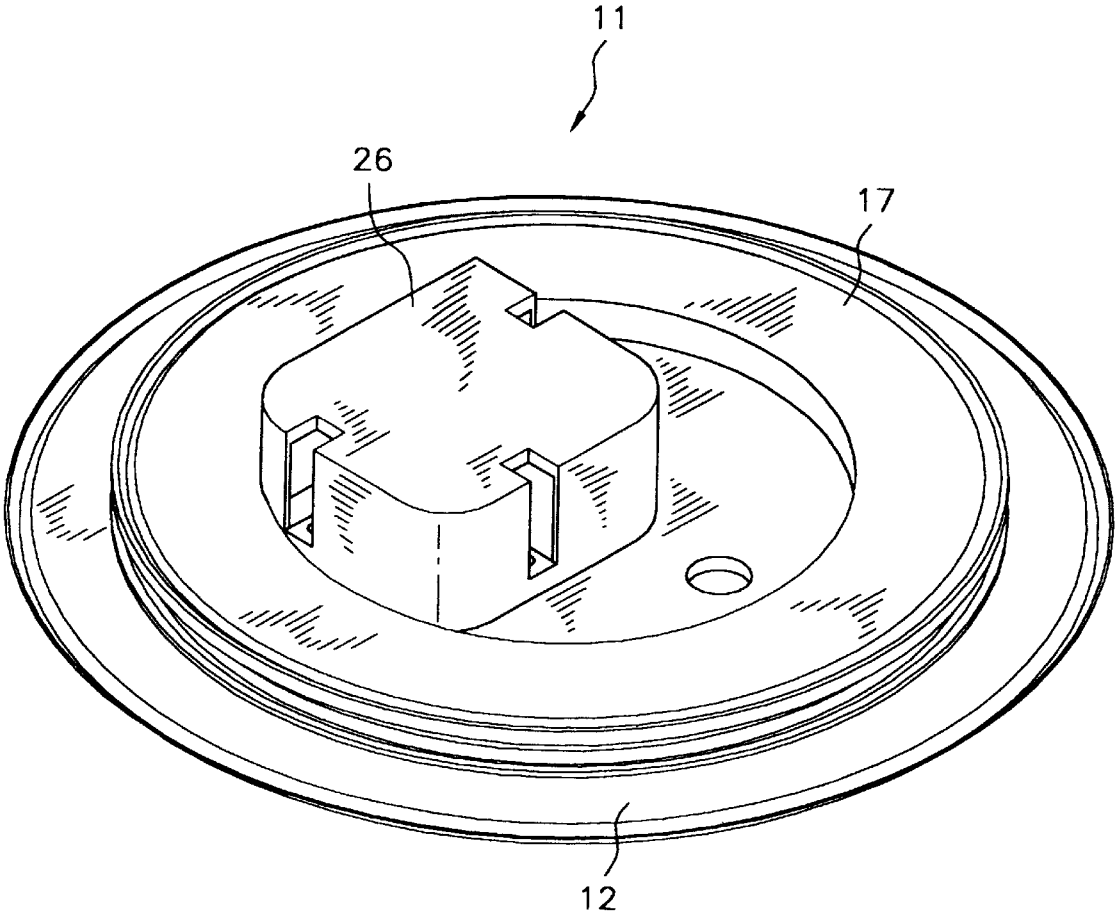
FIG. 2 (Prior Art)
FIG. 2 is a perspective view of the transmission mechanism used in the motion toy shown in FIG. 1.
Figure 3:
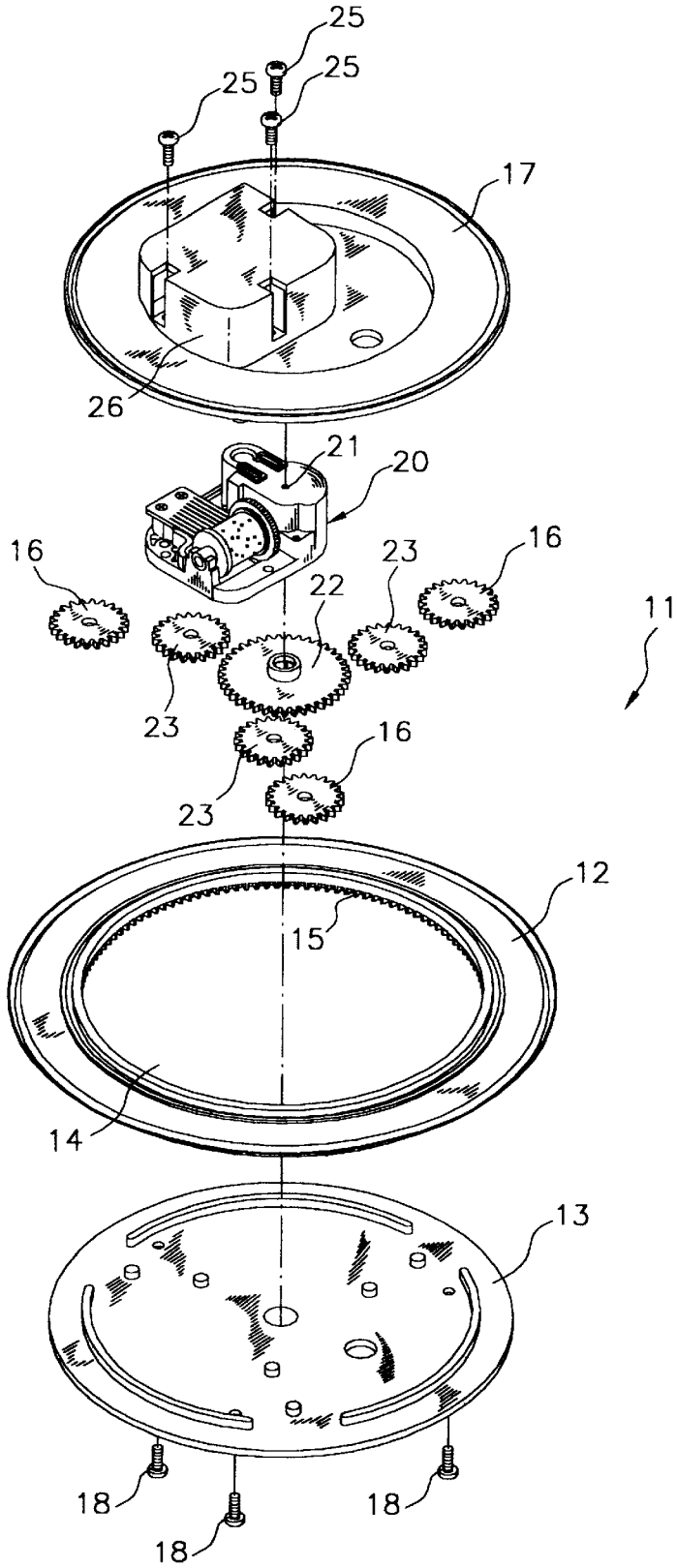
FIG. 3 (Prior Art)
FIG. 3 is an exploded view of the transmission mechanism shown in FIG. 2.
Figure 4:
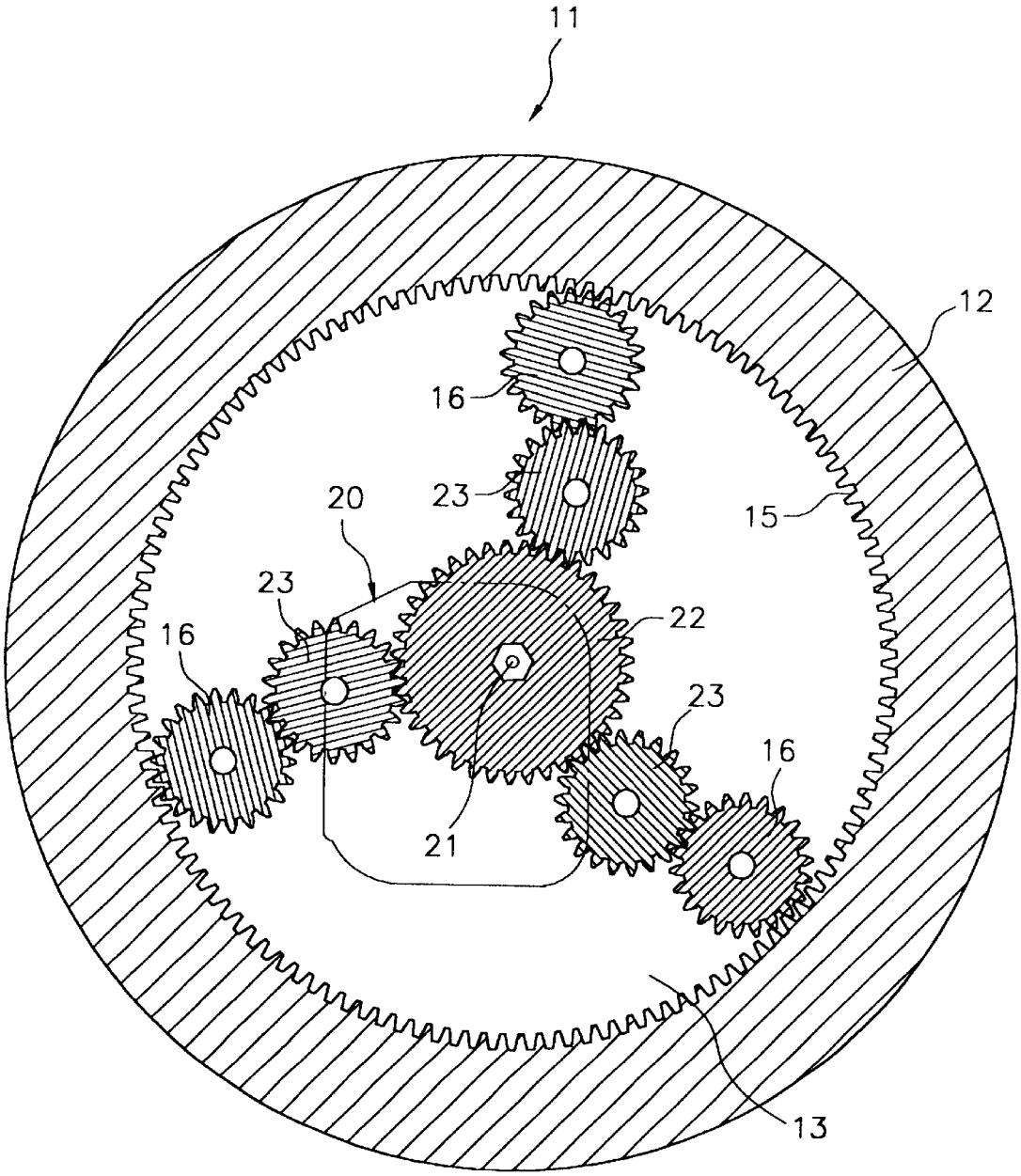
FIG. 4 (Prior Art)
FIG. 4 is a top plain view in section in an enlarged scale of the transmission mechanism shown in FIG. 2.
Figure 5:
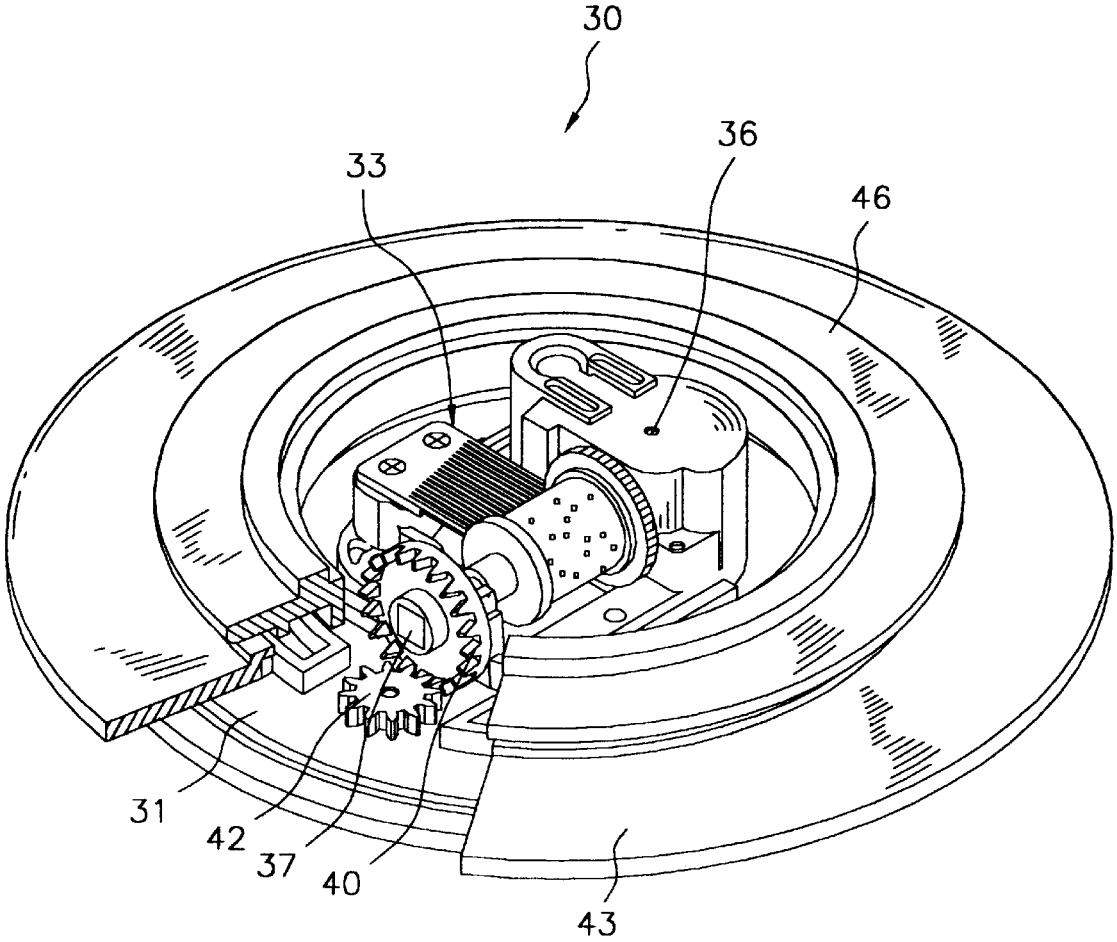
FIG. 5 is a cutaway view of a motion toy transmission mechanism according to the present invention.
Figure 6:
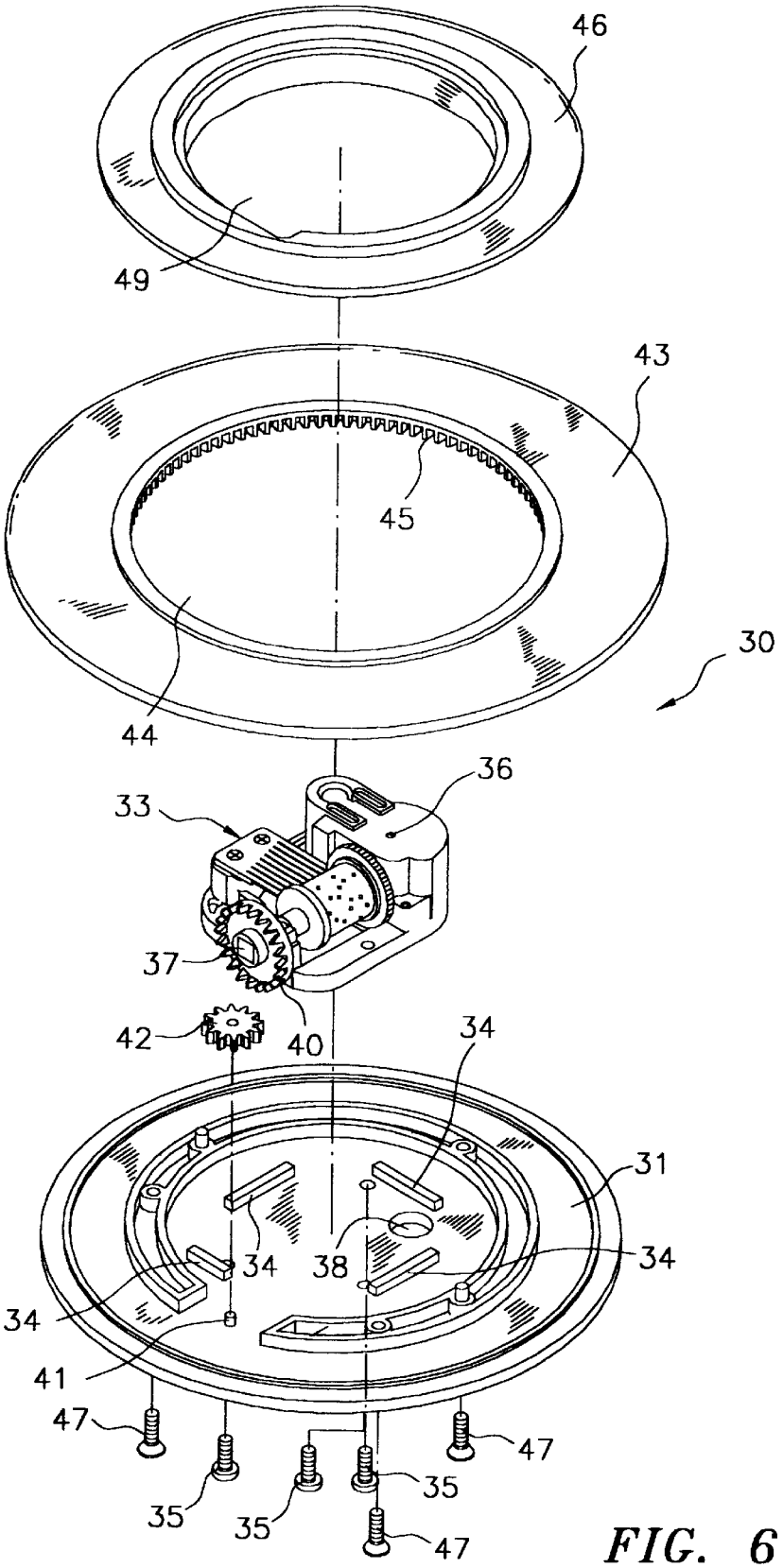
FIG. 6 is an exploded view of the motion toy transmission mechanism shown in FIG. 5.

Referring to FIGS. from 5 through 7, a transmission mechanism 30 is shown comprising a bottom plate 31 holding a musical box 33. The bottom plate 31 comprises a plurality of foot members 32 provided at the bottom side wall thereof, and a plurality of locating ribs 34 raised from the top side wall thereof and defining a space for the positioning of the musical box 33 in place. The musical box 33 is mounted on the top side wall of the bottom plate 31 within the space defined by the locating ribs 34, and fixedly secured to the bottom plate 31 by screws 35. The musical box 33 comprises a clockwork shaft 36 and an output shaft 37 (because the musical box is of the known art and not within the scope of the present invention, it is not described in detail). The clockwork shaft 36 downwardly extends through a through hole 38 on the bottom plate 31. A handle 39 is fixedly fastened to the bottom end of the clockwork shaft 36 and suspended below the bottom plate 31 for turning by hand to fasten up the clockwork of the musical box 33. A drive gear 40 is fixedly mounted on the output shaft 37. The drive gear 40 is a crown gear meshed with a driven gear 42 on an upright shaft 41 at the top side wall of the bottom plate 31. The driven gear 42 is a spur gear meshed with an internal gear 45 around the center opening 44 of a rotary disk 43. The rotary disk 43 is supported on the top side wall of the bottom plate 31, and rotated by the driven gear 42. A pressure member 46 is fixedly fastened to the bottom plate 31 above the rotary disk 43 by screws 47, having a center opening 49, which receives the musical box 33. The peripheral area of the pressure member 46 is disposed in contact with the top side wall of the rotary disk 43, enabling the rotary disk 43 to be smoothly rotated by the driven gear 42.

Figure 7:
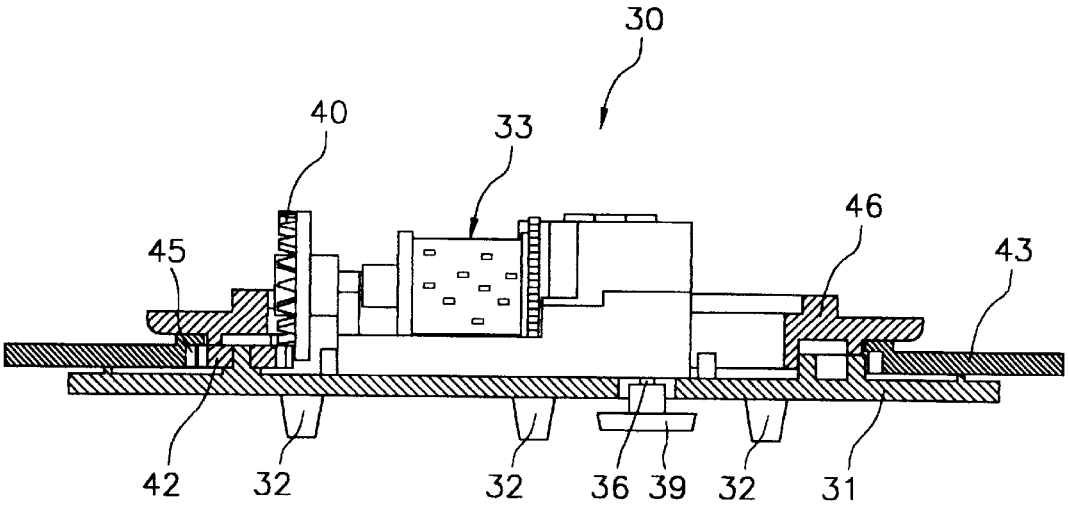
FIG. 7 is a sectional view of the motion toy transmission mechanism shown in FIG. 5.

Referring to FIG. 7 again, when in use, the handle 39 is turned by hand to fasten up the clockwork of the musical box 33. When releasing the hand from the handle 39, the clockwork is loosened gradually, thereby causing the clockwork shaft 36 and the output shaft 37 to be rotated. During rotary motion of the output shaft 37, and the driven gear 42 is driven by the drive gear 40 to rotate the rotary disk 43, and therefore the ornament items (not shown) that are supported on the rotary disk 43 are moved while the musical box 30 playing tunes. Further, ornamental means may be fastened to the clockwork shaft 36 for synchronous rotation with the clockwork shaft 36.

Figure 8:
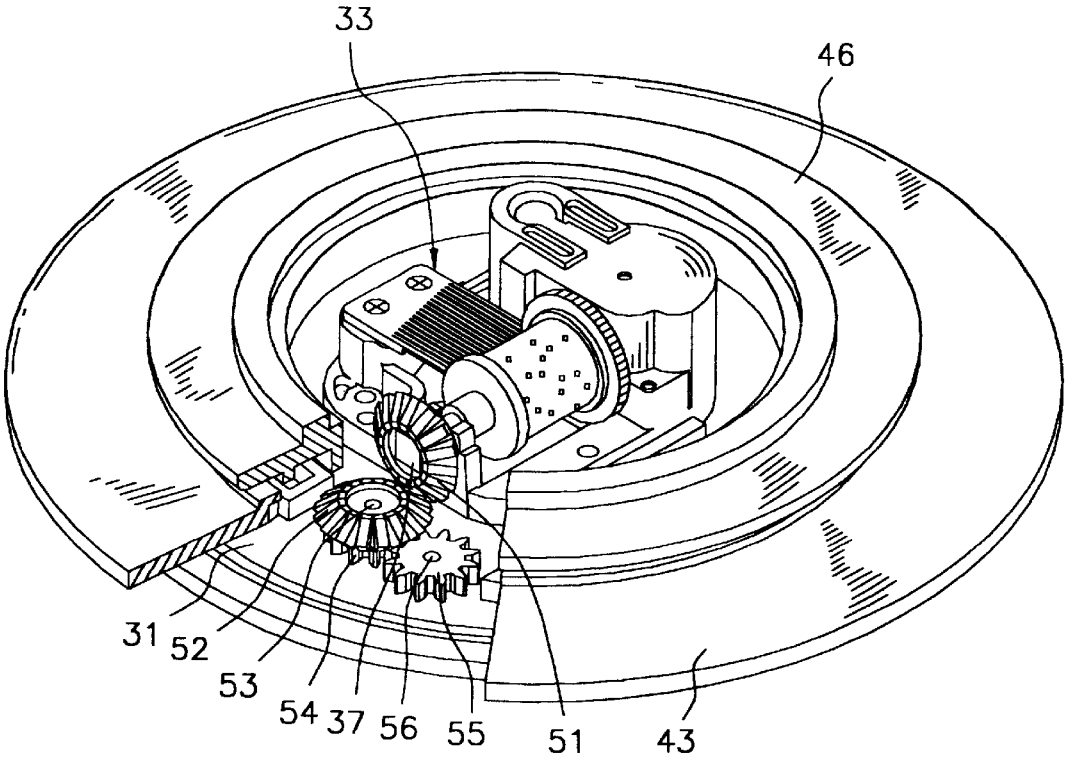
FIG. 8 is a cutaway view of an alternate form of the motion toy transmission mechanism according to the present invention.

FIG. 8 illustrates an alternate form of the present invention. According to this alternate form, two bevel gears, namely, the first bevel gear 51 and the second bevel 52 are used instead of the aforesaid drive gear 40 and driven gear 42. The first bevel gear 51 is fixedly mounted on the output shaft 37. The second bevel gear 52 is revolvably mounted on an upright shaft 53 at the top side wall of the bottom plate 31, and meshed with the first bevel gear 51. Further, a first spur gear 54 is formed integral with the second bevel gear 52, and a second spur gear 55 is mounted an upright shaft 56 at the top side wall of the bottom plate 31 and driven by the first spur gear 54 to rotate the rotary disk 43.

It is to be understood that the drawings are designed for purposes of illustration only, and are not intended for use as a definition of the limits and scope of the invention disclosed.

What the invention claimed is:

1. A motion toy transmission mechanism comprising:

a bottom plate having a top side wall, a bottom side wall, and a through hole through said top side wall and said bottom side wall;

a clockwork-driven musical box fixedly mounted on said bottom plate, said clockwork-driven musical box comprising a clockwork shaft downwardly extended through the through hole on said bottom plate, an output shaft, a clockwork controlled to rotate said output shaft, a handle fixedly fastened to said clockwork shaft and spaced below the bottom side wall of said bottom plate for turning by hand to fasten up said clockwork;

a drive gear fixedly mounted on the output shaft of said clockwork-driven musical box;

a driven gear mounted on said bottom plate and meshed with said drive gear;

a rotary disk supported on the top side wall of said bottom plate and rotated by said driven gear, said rotary disk comprising a center opening and an internal gear disposed around said center opening and meshed with said driven gear; and a pressure member mounted on said bottom plate and spaced around said musical box, said pressure member having a part disposed in contact with said rotary disk at a top side to guide rotary motion of said rotary disk.

2. The motion toy transmission mechanism of claim 1 wherein said drive gear is a crown gear, and said driven gear is a spur gear.

3. The motion toy transmission mechanism of claim 1 wherein said drive gear is a bevel gear, and said driven gear comprising a bevel gear meshed with said drive gear and a first spur gear formed integral with the bevel gear of said driven gear and driven by said drive gear to rotate the internal gear of said rotary disk.

4. The motion toy transmission mechanism of claim 3 further comprising a second spur gear meshed between said first spur gear and the internal gear of said rotary disk.

* * * * *